US012128937B2

(12) United States Patent
Busch et al.

(10) Patent No.: US 12,128,937 B2
(45) Date of Patent: Oct. 29, 2024

(54) VALVE ASSEMBLY AND METHOD FOR CONTROLLING THE AIR SUSPENSION LEVEL OF A RAIL VEHICLE

(71) Applicant: Aventics GmbH, Laatzen (DE)

(72) Inventors: Christian Busch, Hannover (DE); Thomas Paeth, Estorf (DE); Heinz-Hermann Meyer, Seelze (DE)

(73) Assignee: Aventics GmbH, Laatzen (DE)

( * ) Notice: Subject to any disclaimer, the term of this patent is extended or adjusted under 35 U.S.C. 154(b) by 785 days.

(21) Appl. No.: 17/416,733

(22) PCT Filed: Dec. 2, 2019

(86) PCT No.: PCT/DE2019/000308
§ 371 (c)(1),
(2) Date: Jun. 21, 2021

(87) PCT Pub. No.: WO2020/125830
PCT Pub. Date: Jun. 25, 2020

(65) Prior Publication Data

US 2022/0048547 A1 Feb. 17, 2022

(30) Foreign Application Priority Data

Dec. 20, 2018 (DE) ..... 10 2018 009 962.9

(51) Int. Cl.
*B61L 15/00* (2006.01)
*B61F 5/24* (2006.01)

(52) U.S. Cl.
CPC ..... *B61L 15/0058* (2024.01); *B61F 5/24* (2013.01)

(58) Field of Classification Search
CPC ..... B61F 5/24; B61L 15/0058
See application file for complete search history.

(56) References Cited

U.S. PATENT DOCUMENTS 5,943,962 A * 8/1999 Birkhahn ..... B61F 5/245 105/199.2
8,479,659 B2 * 7/2013 Lopez ..... B61D 3/10 105/171

(Continued)

FOREIGN PATENT DOCUMENTS

AT 508 044 A1 10/2010
AT 503 256 B1 10/2011

(Continued)

OTHER PUBLICATIONS

International Search Report corresponding to PCT Application No. PCT/DE2019/000308, mailed Mar. 25, 2020 (German and English language document) (6 pages).

*Primary Examiner* — Scott A Browne
(74) *Attorney, Agent, or Firm* — Maginot, Moore & Beck

(57) ABSTRACT

The disclosure relates to a valve assembly and a method for controlling the air suspension level of a rail vehicle. A system is provided, which is constructionally simple to build and easy to parameterise, for controlling the air suspension level of a rail vehicle. The object of the disclosure is achieved by a valve assembly for controlling the air suspension level of a rail vehicle, comprising a proportional directional valve, a sensor means for continuously detecting a distance variable representing the distance of a carriage body from a chassis or bogie of the rail vehicle, and a digital control device, wherein the control device is designed to be programmable for determining a control deviation based on the actual distance detected by the sensor means and a comparison with a predefinable target distance, and for continuously generating control variables as a linear function of the determined control deviation and the carriage body travelling speed. The object is also achieved by a method for controlling the air suspension level of a rail vehicle with a proportional directional valve, a sensor means (Continued)

for continuously detecting a distance variable representing the distance of the carriage body from a chassis or bogie, and a digital control device, wherein a control deviation is determined by the control device based on a comparison of the actual distances detected by the sensor means with a predefinable target distance, and a control variable is generated continuously as a linear function of the determined control deviation and the carriage body travelling speed.

16 Claims, 3 Drawing Sheets

(56) References Cited

U.S. PATENT DOCUMENTS 10,464,582 B2 * 11/2019 Sato ..... B61F 5/38
2012/0118194 A1 * 5/2012 Schneider ..... B61F 5/24 105/171

FOREIGN PATENT DOCUMENTS

| | | | | |
|---|---|---|---|---|
| DE | 2 216 544 | A1 | | 10/1973 |
| DE | 296 20 200 | U1 | | 3/1998 |
| DE | 199 44 873 | C1 | | 1/2001 |
| DE | 10 2006 005 471 | A1 | | 8/2006 |
| EP | 0 779 167 | A2 | | 6/1997 |
| EP | 2 416 997 | B1 | | 1/2017 |
| EP | 1 993 862 | B1 | | 7/2018 |
| JP | H0757605 | B2 | * | 6/1995 |
| WO | 2005/049345 | A1 | | 6/2005 |
| WO | 2007/104370 | A1 | | 9/2007 |
| WO | 2010/115739 | A1 | | 10/2010 |
| WO | WO 2014010624 | A | * | 1/2014 |

* cited by examiner

VALVE ASSEMBLY AND METHOD FOR CONTROLLING THE AIR SUSPENSION LEVEL OF A RAIL VEHICLE

This application is a 35 U.S.C. § 371 National Stage Application of PCT/DE2019/000308, filed on Dec. 2, 2019, which claims the benefit of priority to Serial No. DE 10 2018 009 962.9, filed on Dec. 20, 2018 in Germany, the disclosures of which are incorporated herein by reference in their entirety.

The disclosure relates to a valve assembly and a method for controlling the air suspension level of a rail vehicle.

BACKGROUND

The use of air suspensions for rail vehicles is known in principle in the prior art. Such air suspensions are conventionally implemented in rail vehicles in the form of air suspension bellows arranged between the carriage body and the undercarriage or bogie of a carriage and serve as secondary suspension for the resilient mounting of the carriage body relative to the undercarriage or bogie. They uncouple the carriage body to the greatest possible extent from unevenness of the railway track by the passive suspension properties and compressibility of the statically inflated air suspension bellows and/or the actively controlled inflation and venting thereof in driving operation. By actively controlling the inflation and venting of the bellows it is at the same time possible in principle to compensate for changes in the level, that is to say in the relative height of the carriage body relative to the undercarriage frame, caused by load changes of a carriage.

DE 22 16 544 C3 discloses an air suspension for rail vehicles in which the inflation and venting of an air suspension device is controlled by means of a leveling valve which is actuated mechanically via a lever and a measuring rod connected to the carriage body and the undercarriage. Such a purely mechanical valve control assembly is structurally relatively complex and, owing to the mechanical activation, is at the same time inflexible in terms of control behavior and can be changed only in a structurally complex manner. The design of such a purely mechanical valve control assembly in terms of control additionally involves a design conflict between, on the one hand, control behavior that is as rapid as possible in the case of significant load changes—for example in the case of the loading of a carriage or the boarding of passengers in stationary operation at a station—and, on the other hand, control in driving operation that is designed to save as much air as possible and, rather, to be slow to respond—for example in the case of purely short-time impact shocks owing to unevenness of the railway track. AU 0 558 363 B2 discloses a technical solution which is comparable in this respect, with an air control valve which is actuated mechanically via a lever and a rod connected to the carriage body and the undercarriage.

DE 296 20 200 U1 discloses an electronic control for an air suspension for rail vehicles having an electropneumatic valve, in which the height of a vehicle superstructure relative to a bogie or undercarriage is detected by means of a height sensor which provides an electrical measurement signal to control electronics. In order to avoid the design conflict already mentioned, a control electronics effects a changeover of the response time or characteristic of the system in stationary operation relative to driving operation. The functioning of the control device is thereby to be configured such that, on the one hand, when the vehicle is stationary (static loads), a very precise height of the vehicle superstructure can be established, wherein on the other hand, while the vehicle is moving (dynamic loads), non-responsiveness to rolling movements, for example, is achieved. A concrete control model for the two operating modes is not disclosed therefor by DE 296 20 200 U1.

Austrian publication AT 503 256 B1 and the publications WO2007/104370 A1 and EP 1 993 862 B1 associated therewith as a joint priority application disclose various forms of an electronic air suspension control for a rail vehicle having a valve which is actuatable mechanically via a rod. In order to avoid the design conflict between control behavior that is as rapid as possible in the case of load changes in stationary operation and air-saving control in driving operation, the publications disclose the additional arrangement of a control valve or of a controllable switching means in the connecting line between the mechanically actuatable valve and at least one air spring in order to allow the air exchange between the mechanically actuatable valve and the at least one air spring to be throttled. Alternatively, the publications further disclose in this respect the arrangement of two control valves or controllable switching means, in each case in the air supply and air discharge line of the mechanically actuatable valve. The air suspension controls disclosed by these publications are structurally relatively complex and require a relatively large installation space, because the electrically or electronically controllable switching means or control valves are provided merely as additional means in addition to the mechanically actuatable valve. Control of inflation and venting is carried out primarily by the valve that is mechanically actuatable via a rod, so that the system is designed relatively inflexibly in terms of function and construction. For example, it is not possible to inflate the air springs independently of the existing carriage lift, for example purely for the purpose of leveling at high platforms. Moreover, mechanical actuation via a rod and lever is subject to relatively high wear owing to its construction. Finally, the publications do not disclose a control model for the electrical or electronic actuation of the additional control valves or controllable switching means for throttling the air exchange. Such a model must first be developed starting from the prior art disclosed by AT 503256 B, WO2007/104370 A1 and EP 1 993 862 B1.

Austrian publication AT 508 044 A1 and the publications WO2010/115739 A1 and EP 2 416 997 B1 associated therewith as a joint priority application disclose a method for controlling an air spring assembly of a vehicle, in which, by activation of at least one valve of the air spring assembly, which valve may be an electronically controllable proportional valve, a height control behavior assigned to a specific condition of the vehicle is set. Discrete condition parameters are derived from the condition of the vehicle and combined into parameter sets, wherein a defined height control behavior is assigned to each parameter set. The height control behavior is purposively specified and set by changing a defined step-shaped profile of valve characteristic curves of the proportional valve on the basis of the limited number of parameter sets. The behavior of the proportional valve is thereby depicted, in simulation of a mechanically actuated valve, in each case solely as a function of the control deviation. The implementation of an electronic control with non-linear valve characteristic curves with a defined step-shaped profile requires the previous modeling of corresponding control profiles as series of fixed values in relation to the discretized condition parameters, wherein corresponding measured values must first be collected in time-consuming preliminary tests and the required correcting variables for each desired valve characteristic curve must be determined, for example iteratively. Furthermore, the specification of a fixed control profile as a series of fixed values has the further disadvantage that disturbance variables (e.g. changed ambient and system temperatures or component tolerances due to wear effects) that are not included in the control profile in question cannot be taken into account, or can be taken into account only insufficiently.

SUMMARY

The object underlying the disclosure is to avoid the described disadvantages. In particular, a system for controlling the air suspension level of a rail vehicle that is structurally simple in terms of construction and easy to parameterize is to be provided.

The object is achieved according to the disclosure by a valve assembly as claimed in claim 1 and by a method as claimed in claim 12. Advantageous further developments of the disclosure are indicated in the dependent claims.

The core of the disclosure is formed by a valve assembly for controlling the air suspension level of a rail vehicle, comprising a proportional directional valve, a sensor means for continuously detecting a distance variable representing the distance of a carriage body from an undercarriage or bogie of the rail vehicle, and a digital control device, wherein the control device is programmed to determine a control deviation on the basis of the actual distance detected by the sensor means and a comparison with a specifiable desired distance, and to continuously generate control variables as a linear function of the determined control deviation and the carriage body traveling speed. A sensor means suitable for this purpose continuously detects a distance variable representing the distance of a carriage body from an undercarriage or bogie of the rail vehicle and converts it into a suitable electrical signal which can be processed by the digital control device. Such a sensor means can be, for example, an angle sensor which detects the distance of the carriage body from the undercarriage or bogie via a mechanical rod by means of a lever, as is disclosed by DE 296 20 200 U1 or WO2010/115739 A1. Such an angle sensor can continuously output the distance variable to the control device electrically as an analog signal or as an incremental signal. In the first case, the sensor signal is subsequently discretized by the digital control device. Other suitable sensor means continuously detect the distance variable, for example, inductively or optically and output it to the control device as an analog or incremental electrical signal value. The determination of the control deviation is carried out by continuously comparing the actual distance detected by the sensor means-which represents the control variable within the closed control circuit-with the specifiable desired distance-which represents the reference variable within the closed control circuit. The control deviation can be taken into account in the linear control function, for example, as the proportional component (P element or P component). The carriage body traveling speed corresponds to the change over time of the control deviation (rate of change) and can be taken into account in the linear control function, for example, as the difference quotient corresponding to the change over time of the control deviation and consequently as the differential component (D element or D component).

The disclosure has recognized that a system for controlling the air suspension level of a rail vehicle that is structurally simple in terms of construction and easily parameterizable is hereby provided. With a proportional directional valve, all the pneumatic control functions required for controlling the air suspension level of a rail vehicle can in principle be reproduced in a simple manner in a single component, namely both the controlled inflation of the air suspension device and the controlled venting of the air suspension device and finally also blocking of the air exchange which may be desired in a particular inflation or venting condition, for example in driving operation. Owing to the implementation of the determined control deviation and of the carriage body traveling speed as a linear electronic control function, effective and rapid compensation for changes in the level of the air suspension, that is to say in the relative height of the carriage body relative to the undercarriage frame or bogie, caused by load changes of a carriage is at the same time ensured, without the need for complex parameterization for this purpose. In particular, complex modeling of a profile as a series of fixed values is not required. By determining the control deviation in the simplest case by comparing the detected actual distance with a single fixedly specifiable value for the desired distance, it is necessary, with the simultaneous use of a standardized linear function, to parameterize only that single fixed value (desired distance). Owing to the configuration as a closed control circuit (also referred to as a closed action circuit) and the fact that the carriage body traveling speed is additionally taken into account, the technical solution at the same time has a very dynamic correction moment for compensating for disturbance variables that are not detected directly. The digital control device required for implementing the electronic control can thereby be integrated, likewise in a space-saving manner, simply as a corresponding microcontroller, into the housing of the proportional directional valve or a common housing for all the components of the valve assembly, for example as a single-board computer (SBC), in which all the electronic components necessary for operation (CPU, memory, input and output interfaces, A/D converter, DMA controller, etc.) are combined on a single printed circuit board. The same applies to the sensor means, which can be integrated, for example in the form of an angle sensor, directly into the housing of the proportional directional valve or a common housing for all the components of the valve assembly, which sensor can be actuated via a lever connected to a mechanical measuring rod. The valve assembly according to the disclosure can further be used for controlling the level of all the pneumatically activatable air suspension devices for the suspension of a vehicle superstructure or of a body relative to a vehicle undercarriage or bogie which permit controlled inflation or venting, such as, for example, an air suspension bellows, an assembly of a plurality of air suspension bellows or, for example, also an assembly of one or more pneumatic suspension cylinders.

By including the carriage body traveling acceleration as an additional control parameter of the linear function, a further increased dynamics and sensitivity of the response behavior of the valve assembly is achieved. The carriage body traveling acceleration corresponds to the change over time of the carriage body traveling speed and can be taken into account in the linear control function, for example, as a further difference quotient corresponding to the change over time of the carriage body traveling speed and consequently as a further differential component.

A flexibilization of the control behavior of the valve assembly is achieved in that the dynamics of the control function can be selected, specified or adjusted by a changed parameterization of individual control parameters or the setting of a modification factor for the control effect, the control variable or the detected actual distance. The changed parameterization is effected, for example, by setting a different desired distance or setting or changing coefficients for individual or multiple control parameters, that is to say the desired distance, the control deviation and/or the carriage body traveling speed and/or the carriage body traveling acceleration. Likewise, the dynamics of the control effect can be selected, specified or adjusted alternatively by the setting of a global modification factor for the control effect, the control variable to be generated or the detected actual distance. The modification factor can be selected to be attenuating or intensifying, so that the target dynamics of the control is lowered or increased in percentage terms.

A flexibilization of the control behavior of the valve assembly is likewise achieved or further increased in that the dynamics of the control function can be selected, specified or adjusted by intensity- and/or time-related filtering of the actual distance or of the control deviation. Such filtering eliminates, for example, all the actual distances or control deviations below a definable value. In this case, the control responds only above a determinable actual distance or a determinable control deviation. Alternatively or cumulatively, the filtering can be in the form of temporal filtering, in which actual distances or control deviations lead to a control activity only after a determinable temporal duration. In this case, the control responds only to changes in the actual distances or control deviations that have a specific temporal duration, so that, for example, disturbing variables that occur for only a short time (for example short-time impacts in driving operation) are filtered out. The two filtering variants can also be combined with one another, so that the control responds only above an actual distance or a control deviation of a determinable size and a determinable temporal duration.

Because the dynamics of the control functions or the filtering can be selected, specified or adjusted on the basis of the mode of operation or of the traveling speed of the rail vehicle, simple automated allocation of different control dynamics to different modes of operation is made possible. For example, a different desired distance can be specified for stationary operation and driving operation. Furthermore, an increased control dynamics for compensating for load changes in stationary operation and a slower control behavior with reduced air consumption in driving operation can be automated in a simple manner.

In a structurally advantageous form of the valve assembly, the proportional directional valve is a 3-way proportional valve which has a venting position and an inflation position, each with continuously variable opening cross sections, and a closed position. With such a directional valve, all expedient pneumatic control functions can be reproduced simply and effectively, namely controlled inflation of the air suspension device, controlled venting of the air suspension device and finally also blocking of the air exchange in a specific inflation condition of the air suspension device, for example in order to reduce the air consumption in driving operation. When the air exchange is blocked in driving operation, the current inflation of the air suspension device is "frozen" with a determinable pressure, and the air suspension device is limited to its passive suspension properties.

When using a proportional directional valve or a 3-way proportional valve which in its rest position, and thus also in the deenergized state, occupies an open position and vents the air suspension device connected thereto, a so-called "failsafe" function for ensuring operational reliability may be desired, in order to prevent the system from being vented in the event of a power failure. In order to implement such a failsafe function, an electronically controllable switching means is arranged downstream of the venting connection of the proportional directional valve or of the 3-way proportional valve, which switching means occupies a closed position in the deenergized state and an open position in the actuated state. Unintentional venting of the valve and thus also of the system as a whole in the deenergized state is thus reliably prevented. Such a switching means can be, for example, a 2/2 switching valve.

In order to further increase the operational reliability, failsafe overpressure relief may further be desirable. For this purpose, a working connection of the proportional directional valve or of the 3-way proportional valve is connected via a connecting line to a combined inflation/venting connection of at least one air suspension device and at the same time there is arranged with the connecting line a switching means which is actuatable mechanically via a lever and a measuring rod connected to the carriage body and the undercarriage, which switching means occupies a closed position in its rest position and, from a lever position representing a determinable actual distance, switches into an open position, wherein it connects the connecting line to a venting outlet.

For connection to external electronic control systems, for example a superordinate train control, the control device is configured with at least one data communication interface which is compatible with at least one industrial protocol standard. It may be, for example, a wired field bus interface which is compatible with the industrial standards Profibus, DeviceNet/ControlNet or CANopen, or a wired network interface which is compatible with the industrial standards Profinet, EtherNet/IP, Ethernet Powerlink or EtherCat (industrial Ethernet). Such a data communication interface can be designed to be compatible with multiple protocol standards (data transmission protocols) simultaneously. The data communication interface can further be in the form of a wireless data communication interface, for example an industrial WLAN interface (IWLAN).

For functional integration into external electronic control systems, for example a superordinate train control, the control device is programmed to parameterize or to select, specify or adjust the dynamics of the control function or of the filtering via the data communication interface. On the one hand, this allows the control dynamics to be parameterized remotely or adjusted remotely via a superordinate train control. Furthermore, it allows the valve assembly to be functionally incorporated into a superordinate train control in that the control device receives the information about the current mode of operation (driving operation/stationary operation) via the data communication interface and adjusts the control dynamics accordingly. Finally, it also allows the superordinate train control to intervene in the control dynamics for the running time by specifying to the control device for the running time, for example, a changed parameterization or dynamics of the control function or filtering.

A further safety function is provided by configuring the proportional directional valve or 3/3-way proportional valve with a sensor means for detecting the valve output pressure and programming the control device to determine a definable pressure drop and to generate an error signal and transmit that signal via the data communication interface. A defect of the air suspension device (for example a leakage or the bursting of an air suspension bellows) results in a pressure drop on the working side of the proportional directional valve or 3-way proportional valve. This can be detected by a sensor means for detecting the valve output pressure that is integrated into the valve. In this case, the control device generates an error signal and transmits it via the data communication interface, for example, to a superordinate train control, whereby the vehicle driver or a control center is informed automatically of the defect.

A further core of the disclosure is formed by a method for controlling the air suspension level of a rail vehicle with a proportional directional valve, a sensor means for continuously detecting a distance variable representing the distance of the carriage body from an undercarriage or bogie, and a digital control device, wherein a control deviation is determined by means of the control device on the basis of a comparison of the actual distances detected by the sensor means with a specifiable desired distance, and a control variable is continuously generated as a linear function of the determined control deviation and the carriage body traveling speed. By means of the method it is ensured that changes in the level of the air suspension, that is to say in the relative height of the carriage body relative to the undercarriage frame or bogie, are compensated for highly effectively and rapidly, without complex parameterization being required for this purpose.

An increase in the possible dynamics and sensitivity of the response behavior of the control method is achieved by including the carriage body traveling acceleration as an additional control parameter of the linear function.

A flexibilization of the control behavior is achieved in that the dynamics of the control function can be selected, specified or adjusted by a changed parameterization of individual control parameters or the setting of a modification factor for the control effect, the control variable or the actual distance.

A further flexibilization of the control behavior is achieved in that the dynamics of the control function can be selected, specified or adjusted by intensity—and/or time-related filtering of the actual distance or of the control deviation.

Simple, automated allocation of different control dynamics to different modes of operation is made possible in that the dynamics of the control functions and/or the filtering can be selected, specified or adjusted on the basis of the mode of operation or the traveling speed of the rail vehicle.

BRIEF DESCRIPTION OF THE DRAWINGS

Further advantages of the disclosure will be explained in greater detail hereinbelow by means of the figures together with the description of preferred exemplary embodiments of the disclosure. In the figures:

FIG. 3 FIG. 2 is a diagram with a characteristic field of the control behavior of the valve assembly.

DETAILED DESCRIPTION

Figure 1:
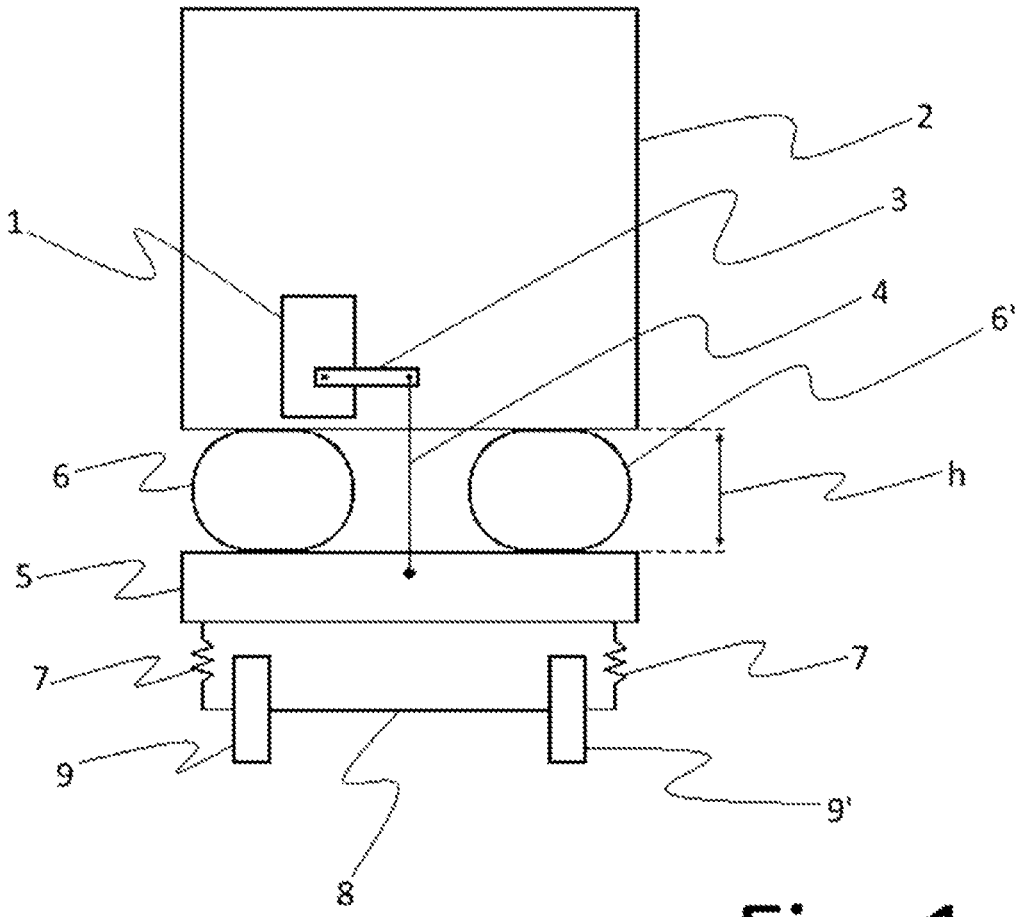
FIG. 1 is a schematic rear view of a portion of a rail vehicle having an air suspension and a valve assembly.

FIG. 1 shows a portion of a rail vehicle in a schematic rear view. The valve assembly 1 is arranged in the lower region of a carriage body 2. It is mechanically connected to the undercarriage frame 5 via the lever 3 and the measuring rod 4. The undercarriage frame 5 can here also be in the form of a bogie. Between the undercarriage frame 5 and the carriage body 2 there is arranged as secondary suspension an air suspension device, which is formed by the two air suspension bellows 6 and 6'. The current lift h of the secondary suspension 6 is thus identical to the distance of the carriage body 2 from the undercarriage frame 5. Alternatively, the secondary suspension can also be in the form of a single suspension bellows. Beneath the undercarriage frame 5 there is arranged the primary suspension 7, by means of which the wheel axle 8 and the two wheels 9 and 9' are resiliently mounted relative to the undercarriage 5. The current lift h of the secondary suspension 6 is dependent on the current load of the carriage body 2 and is represented mechanically by the position of the measuring rod 4 and of the lever 3 connected thereto.

Figure 2:
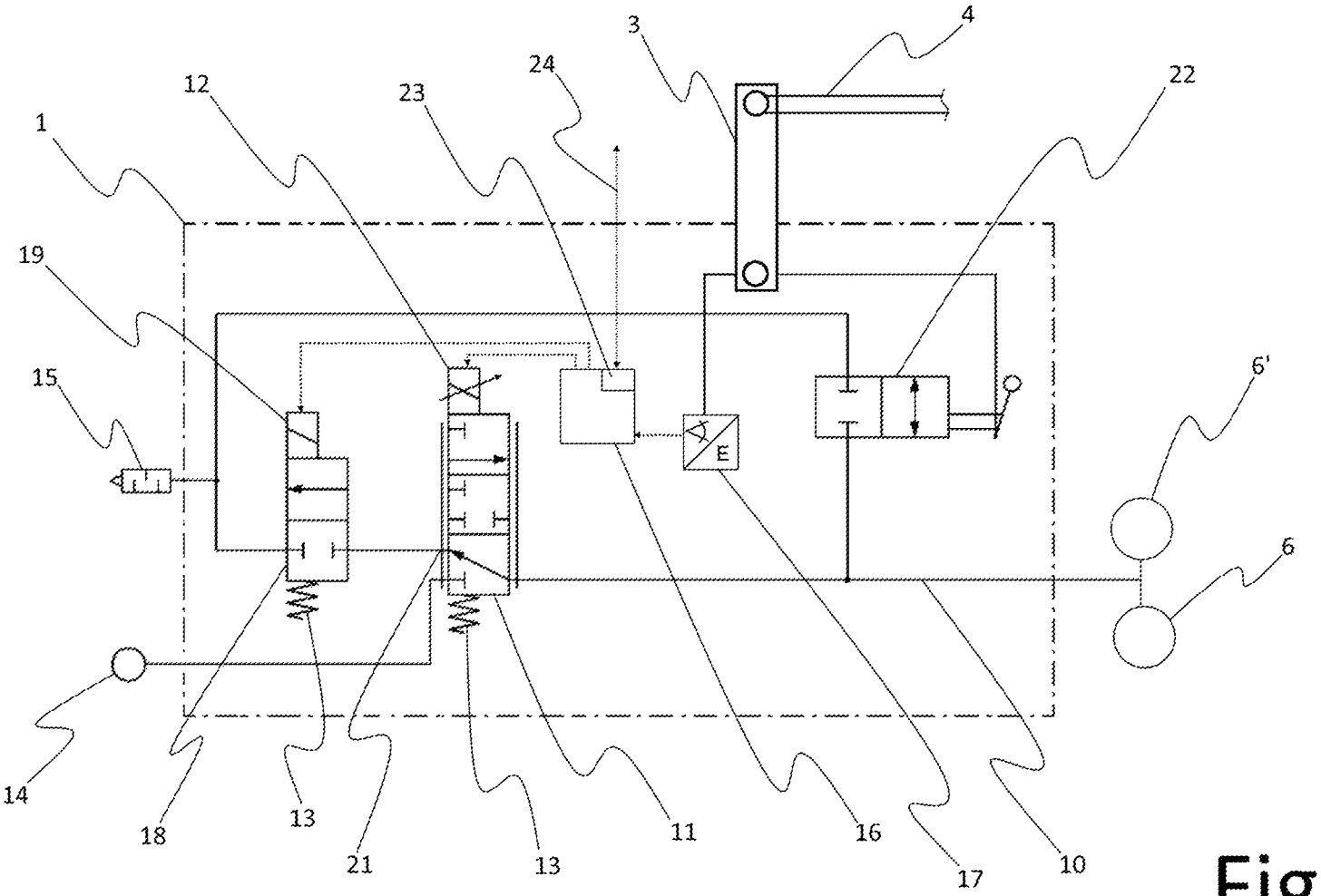
FIG. 2 is a schematic diagram of a valve assembly according to FIG. 1 for controlling the air suspension level of a rail vehicle.

FIG. 2 shows a schematic diagram of the valve assembly 1 with the lever 3 and the measuring rod 4, which is shown only in truncated form in FIG. 2, and the air suspension bellows 6 and 6'. The components of the valve assembly 1 are formed in a common housing—symbolized by a dot-and-dash border. The measuring rod 4 is articulated with this housing via the lever 3. For inflating and venting the two air suspension bellows 6 and 6', which are arranged outside the housing of the valve assembly 1 and are connected to the valve assembly via the connecting line 10, the 3/3-way proportional valve 11 is arranged in the connecting line 10. The 3/3-way proportional valve 11 is activatable via the proportional solenoid 12 against the spring load of the mechanical return spring 13 and connects the air suspension bellows 6 and 6' via the connecting line 10, in each case with changeable valve opening cross sections, in a switch position to the compressed air source 14 and in its starting and rest position to the venting outlet 15. The compressed air source 14 can be a compressed air pump, a compressor or, for example, also an interposed compressed air reservoir. The 3/3-way proportional valve 11 can further be switched, via the proportional solenoid 12, into a closed middle position, in which the connecting line 10 is completely closed. In its rest position in the deenergized state, the 3/3-way proportional valve 11 is switched completely into its venting position, in which the connecting line 10 is connected without throttling to the venting outlet 15. The electronic activation of the proportional solenoid 12 takes place via a control device, which is integrated in the form of a microcontroller 16 into the valve assembly 1. The microcontroller 16 is in the form of a single-board computer (SBC), in which all the electronic components necessary for operation (CPU, memory, input and output interfaces, A/D converter, DMA controller, etc.) are combined on a single printed circuit board. The microcontroller 16 receives from the angle sensor 17 a continuous electrical signal, which represents the current distance h of the carriage body 2 from the undercarriage frame 5. The angle sensor 17 is for this purpose connected mechanically to the lever 3 and detects the current actual distance via the position of the lever. The microcontroller 16 is programmed to determine a control deviation e on the basis of the actual distance detected and transmitted by the angle sensor by comparing the actual distance with a specifiable desired distance, and to continuously generate control variables u for the actuation of the proportional solenoid 12 of the 3/3-way proportional valve 11 as a linear function of the determined control deviation e and the carriage body traveling speed $\dot{x}$ derivable on the basis of the change over time of the actual distance. If the desired distance specified for the running time is constant over time, the carriage body traveling speed is also derivable directly on the basis of the change over time of the determined control deviation e. The carriage body acceleration $\ddot{x}$ derivable on the basis of the change over time of the carriage body traveling speed $\dot{x}$ can additionally be taken into account as a further control parameter. Each control parameter can thereby be configured to be parameterizable via coefficients $k_1, k_2 k_3$, so that $u=f(k_1 e, k_2 \dot{x}, k_3 \ddot{x})$ applies.

The valve assembly 1 further comprises the electrically actuatable switching valve 18. The switching valve 18 is switchable via the switching solenoid 19 against the spring load by the mechanical return spring 20 and connects the venting connection 21 of the 3/3-way proportional valve 11 in its switched state to the venting outlet 15 and closes the venting outlet 21 in its deenergized starting and rest position (normal closed=NC). In normal operation, the switching valve 18 is switched open via the microcontroller 16. In the case of a power failure, the switching valve 18 closes automatically and thus prevents venting of the 3/3-way proportional valve 11 and thus also of the system as a whole (consequently also of the air suspension bellows 6 and 6' and the compressed air source 14, which can also be, for example, an interposed pressure reservoir).

Finally, the valve assembly 1 comprises the mechanically actuatable shut-off valve 22. This valve is closed in its rest state but switches into an open position by mechanical actuation via the lever 3 from a lever position representing a specific lift h, whereby it connects the connecting line 10 to the venting outlet 15.

The microcontroller 16 is configured with a data communication interface 23. The data communication interface 23 serves for data connection with a superordinate train control (not shown in FIG. 2) via the data communication line 24. The data communication interface 23 is for this purpose configured, as required, as, for example, a field bus interface (for example compatible with Profibus, DeviceNet/ControlNet or CANopen) or as an industrial Ethernet interface (for example compatible with Profinet, EtherNet/IP, Ethernet Powerlink or EtherCat). It can be configured to be compatible with multiple protocol standards simultaneously. By means of the data communication interface 23, the microcontroller 16 can be integrated into a superordinate train control in that, for example, the parameterization or adjustment of the dynamics of the control function or of the filtering for programming the microcontroller 16 can be selected, specified or adjusted by the superordinate control. Conversely, the microcontroller 16 can also be programmed to report process values to the superordinate train control, for example the actual distance.

Figure 3:
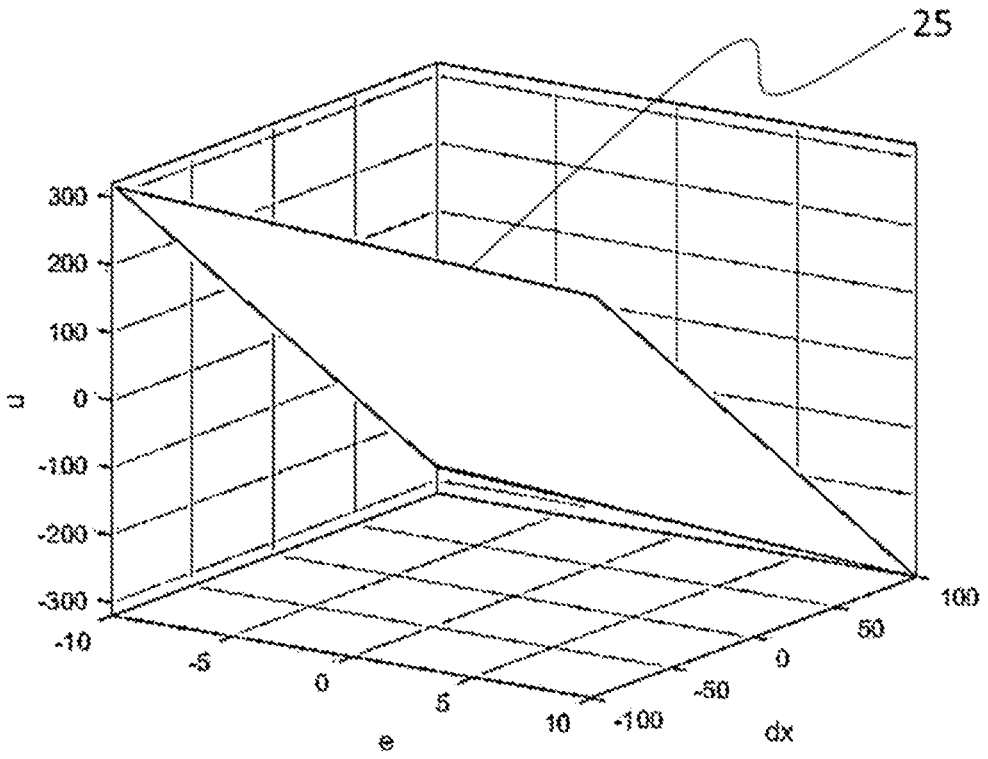

The control behavior of an exemplary linear control function for determining the control variable by the correspondingly programmed microcontroller 16 is depicted in FIG. 3 as a characteristic area 25. The characteristic area 25 thereby represents the control space for the control variable values u in dependence on determined control deviation values e as the proportional element and carriage body traveling speed values $\dot{x}$ (dx) as the differential element of the exemplary linear control function.

LIST OF REFERENCE NUMERALS

1 valve assembly
2 carriage body
3 lever
4 measuring rod
5 undercarriage frame
6, 6' air suspension bellows
7 primary suspension
8 wheel axle
9, 9' wheel
10 connecting line
11 3/3-way proportional valve
12 proportional solenoid
13, 20 return spring
14 compressed air source
15 venting outlet
16 microcontroller
17 angle sensor
18 switching valve
19 switching solenoid
21 venting connection
22 shut-off valve
23 data communication interface
24 data communication line
25 characteristic area

The invention claimed is:

1. A valve assembly for controlling an air suspension level of a rail vehicle, comprising:
a proportional directional valve;
a sensor means for continuously detecting a distance variable representing an actual distance of a carriage body from an undercarriage or bogie of the rail vehicle; and
a digital control device,
wherein the control device is programmed (i) to determine a control deviation on the basis of the actual distance detected by the sensor means and a comparison with a specifiable desired distance, and (ii) to continuously generate control variables as a control function of the determined control deviation and a traveling speed of the carriage body, and
wherein the control function is a linear function.

2. The valve assembly as claimed in claim 1, wherein a traveling acceleration of the carriage body is included as a control parameter of the control function.

3. The valve assembly as claimed in claim 1, wherein:
the control function includes a plurality of control parameters, and
control dynamics of the control function can be selected, specified, or adjusted by (i) a changed parameterization of individual control parameters of the plurality of control parameters, or (ii) setting a modification factor for a the control effect action, the control correcting variables variable, or the actual distance.

4. The valve assembly as claimed in claim 1, wherein control the dynamics of the control function can be selected, specified, or adjusted by intensity- and/or time-related filtering of the actual distance or of the determined control deviation.

5. The valve assembly as claimed in claim 4, wherein the control dynamics of the control function or the filtering can be selected, specified, or adjusted on the basis of a mode of operation or the traveling speed of the rail vehicle.

6. The valve assembly as claimed in claim 1, wherein the proportional directional valve is a 3-way proportional valve which has a venting position and an inflation position, each with continuously variable opening cross sections, and a closed position.

7. The valve assembly as claimed in claim 1, wherein:
the proportional directional valve occupies a venting position in a deenergized state,
an electronically controllable switching means is arranged downstream of a venting connection of the proportional directional valve,
the switching means occupies a closed position in the deenergized state and an open position in an actuated state.

8. The valve assembly as claimed in claim 1, wherein:
a working connection of the proportional directional valve is connected by a connecting line to a combined inflation/venting connection of at least one air suspension device, a switching means is arranged with the connecting line which is actuatable mechanically by a lever and a measuring rod connected to the carriage body and the undercarriage, and the switching means occupies a closed position in a rest position and, from a lever position representing a determinable actual distance, switches into an open position in which the switching means connects the connecting line to a venting outlet.

9. The valve assembly as claimed in claim 1, wherein the control device is configured with at least one data communication interface which is compatible with at least one industrial protocol standard.

10. The valve assembly as claimed in claim 4, wherein the control device is programmed to parameterize or to select, specify, or adjust the control dynamics of the control function or of the filtering with at least one data communication interface which is compatible with at least one industrial protocol standard.

11. The valve assembly as claimed in claim 9, wherein:

the proportional directional valve is configured with a sensor means for detecting a valve output pressure, and the control device is programmed to determine a definable pressure drop and to generate an error signal and transmit the error signal using the at least one data communication interface.

12. A method for controlling an air suspension level of a rail vehicle with a proportional directional valve, a sensor means for continuously detecting a distance variable representing an actual the distance of a carriage body from an undercarriage or bogie of the rail vehicle, and a digital control device, comprising:

determining a control deviation by means of the control device on the basis of a comparison of the actual distance detected by the sensor means with a specifiable desired distance; and continuously generating a control variable as a control function of the determined control deviation and a traveling speed of the carriage body, wherein the control function is a linear function.

13. The method as claimed in claim 12, wherein a traveling acceleration of the carriage body is included as a control parameter of the control function.

14. The method as claimed in claim 12, wherein:

the control function includes a plurality of control parameters, and control dynamics of the control function can be selected, specified, or adjusted by (i) a changed parameterization of individual control parameters of the plurality of control parameters, or (ii) setting a modification factor for a control effect, the control variables, or the actual distance.

15. The method as claimed in claim 12, wherein control dynamics of the control function can be selected, specified, or adjusted by intensity- and/or time-related filtering of the actual distance or of the determined control deviation.

16. The method as claimed in claim 15, wherein the control dynamics of the control function and/or the filtering can be selected, specified, or adjusted on the basis of a mode of operation or the traveling speed of the rail vehicle.

* * * * *